US007580667B2

(12) United States Patent
Ueda et al.

(10) Patent No.: US 7,580,667 B2
(45) Date of Patent: Aug. 25, 2009

(54) IMAGE FORMING SYSTEM, IMAGE FORMING APPARATUS AND PROGRAM

(75) Inventors: Akio Ueda, Hino (JP); Junji Sato, Hachioji (JP); Shoichi Nakamura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 333 days.

(21) Appl. No.: 11/508,027

(22) Filed: Aug. 22, 2006

(65) Prior Publication Data

US 2007/0047997 A1 Mar. 1, 2007

(30) Foreign Application Priority Data

Sep. 1, 2005 (JP) ..... 2005-253207
May 31, 2006 (JP) ..... 2006-151362

(51) Int. Cl.
*G03G 15/00* (2006.01)

(52) U.S. Cl. ..... 399/407; 399/82

(58) Field of Classification Search ..... 399/407
See application file for complete search history.

(56) References Cited

FOREIGN PATENT DOCUMENTS

| | | | |
|---|---|---|---|
| JP | 02138074 A | * | 5/1990 |
| JP | 7-129043 A | | 5/1995 |
| JP | 2000092307 A | * | 3/2000 |
| JP | 2004-235720 A | | 8/2004 |
| JP | 2005-138961 A | | 6/2005 |

* cited by examiner

*Primary Examiner*—Daniel J Colilla
*Assistant Examiner*—Allister Primo
(74) *Attorney, Agent, or Firm*—Frishauf, Holtz, Goodman & Chick, P.C.

(57) ABSTRACT

Based on the image size and folding setting, a recording medium storing device is selected among a plurality of the recording medium storing devices, an image is formed on a recording medium in the selected recording medium storing device based on image information, and the recording medium on which the images is formed is folded by a folding device.

15 Claims, 5 Drawing Sheets

FIG. 4 (A)
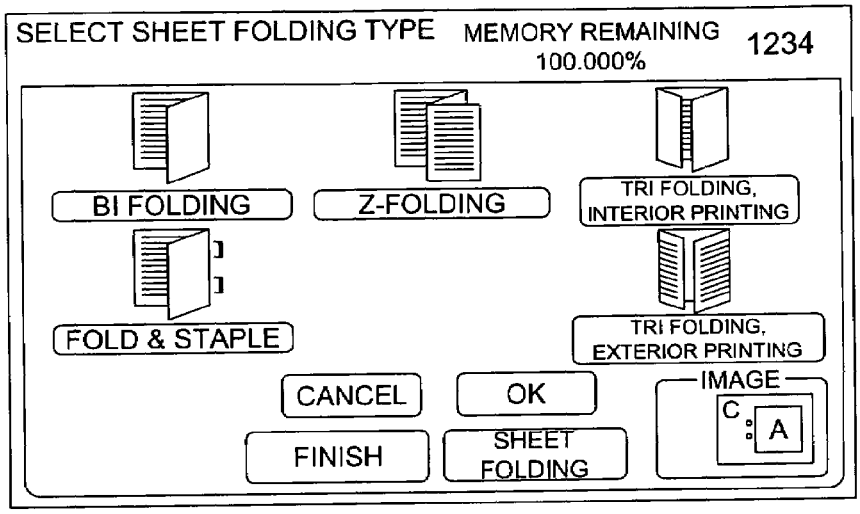
FIG. 4 (B)
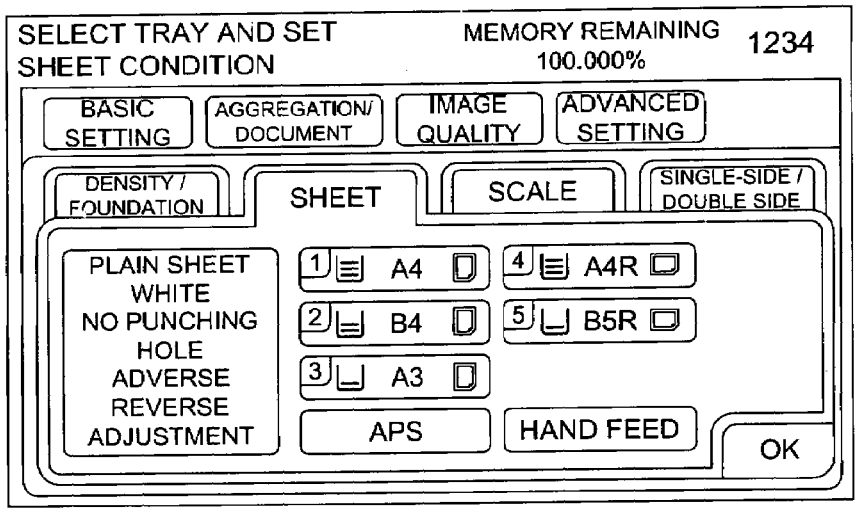
FIG. 4 (C)
| | SHEET FEEDING CASSETTE | | RECORDING MEDIUM CAN BE FED |
|---|---|---|---|
| | A4 | A4R | |
| | a | b | |
| 1 | NOT AVAILABLE | NOT AVAILABLE | NOT AVAILABLE |
| 2 | NOT AVAILABLE | AVAILABLE | A4R |
| 3 | AVAILABLE | NOT AVAILABLE | NOT AVAILABLE |
| 4 | AVAILABLE | AVAILABLE | A4R |

IMAGE FORMING SYSTEM, IMAGE FORMING APPARATUS AND PROGRAM

This application is based on Japanese Patent application No. 2005-253207 filed on Sep. 1, 2005 and No. 2006-151362, filed on May 31, 2006 in Japanese Patent Office, the entire content of which is hereby incorporated by reference.

FIELD OF THE INVENTION

The present invention relates to an image forming system, an image forming apparatus, and program.

BACKGROUND OF THE INVENTION

There has been known an image forming apparatus having APS (Auto Paper Select) function which automatically selects a recording medium from paper feeding cassette based on a document size and magnification and conveys to improve user-friendliness for users.

The Patent Document 1 discloses an image forming apparatus having APS function wherein in case media in feeding cassette are used up while forming an image, if a cassette storing the same size recording medium having the same direction does not exist and if a cassette storing the same size recording medium having a different direction exists, image forming is continued by turning around the image by 90 degree to form the image on the same size recording medium having the different direction.

[Patent Document 1] Official Gazette of Japanese Patent Tokkaihei 7-129043

In recent years, a number of image forming apparatus capable of being connected with post process apparatuses having folding function are on the market.

In such image forming apparatus, if APS function and folding function are simultaneously used, APS function may accidentally select a recording medium which cannot be folded by the APS function. Thus, image forming is discontinued.

For example, in case tri-folding is designated for A4-longitudinal (longitudinal means a short side of the recording medium is parallel to a medium conveying direction) document, usually, tri-folding is not likely to be executed for A4 recording medium, execution of tri-folding is made impossible. A4 longitudinal recoding medium has a mechanical difficulty in folding, since A4 longitudinal orientation recoding medium is short in the conveying direction compared to A4 lateral recording medium.

The technology in Patent Document 1 is a technology which enables to continue image forming when the sheet in use is used up however, it does not consider folding in continuation of the image forming.

SUMMARY OF THE INVENTION

The invention has been achieved in view of the above problems, and an object-of the present invention is to provide an image forming system, an image forming apparatus and a computer program used for these image forming system and apparatus having high user friendliness by optimizing selection of recording medium when folding is carried out.

The above-mentioned problems are solved by the followings:

An image forming system including: a plurality of recording medium storing devices to store recording media; an image input device to be inputted with image information; an image forming device to form an image in the recording medium based on the image information inputted through the image input device; a folding device to fold the recording media, wherein the image is formed through the image forming device; an image size obtaining device to obtain image size of the image information inputted through the image input device; an folding setting input device to be inputted with folding setting; and a control device to select a recording medium storing device among a plurality of recording medium storing devices based on the folding setting by folding setting input device and the image size obtained through the image size obtaining device, to form the image on the recording medium stored in the selected recording medium storing device through the image forming device based on the image data inputted through image inputting device, and to control the folding device so as to fold the recording medium, wherein the image is formed.

An image forming apparatus, including: a plurality of recording medium storing devices to store recording media; an image input device to be inputted with an image information; an image forming device to form an image in the recording medium based on the image information inputted through the image input device; an image size obtaining device to obtain an image size of the image information inputted by the image input device; a folding setting input device to be inputted with folding setting; and a control device to select a recording medium storing device among a plurality of the recording medium storing devices based on the folding setting by folding setting input device and on the image size obtained through the image size obtaining device, and to control forming the image on the recording medium stored in the selected recording medium storing device by the image forming device based on the image data inputted through image inputting device.

A computer program for controlling a computer to execute steps of: inputting an image information; obtaining an image size of the image information; inputting folding setting; selecting a recording medium storing device from a plurality of recording medium storing devices based on the image size and the folding setting; and forming an image from the image information on the recording medium stored in the selected recording medium storing device.

According to the present invention, by selecting a recording medium capable of being folded within recording media in the same size, needless interruption of image forming by selecting a recording medium not capable of folding is prevented, thus, user-friendliness is improved.

BRIEF DESCRIPTION OF THE DRAWINGS

FIG. 4 is a pattern diagram showing an example of setting screen of the present embodiment.

DETAILED DESCRIPTION OF THE PREFERRED EMBODIMENT

<System Structure>

Figure 1:
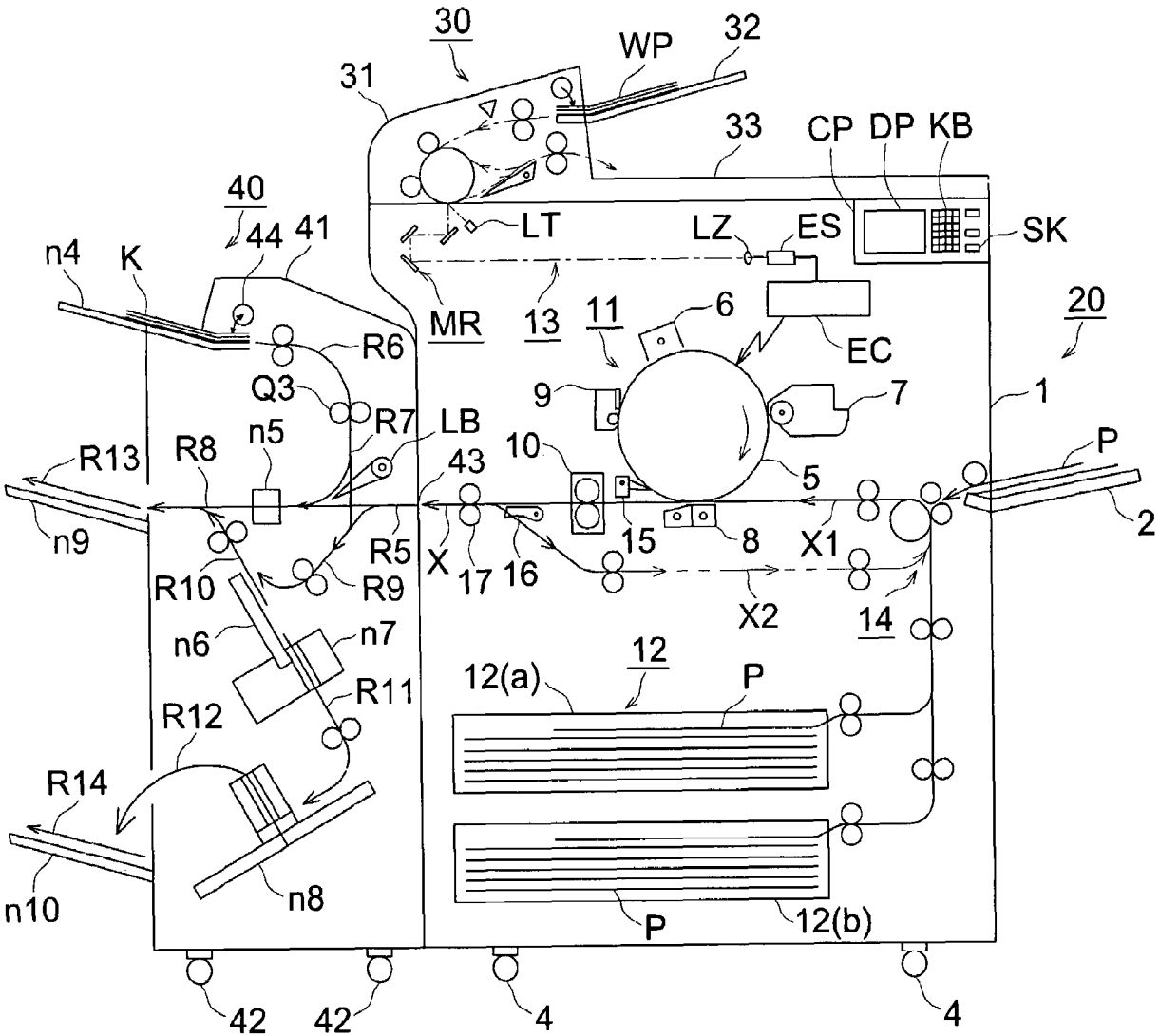
FIG. 1 is a structural diagram of image forming system of the present embodiment.

FIG. 1 is structural drawing of an image forming system of the present embodiment. In the image forming system of the present embodiment, automatic document feeding apparatus (ADF) 30 and post-process apparatus 40 are connected to image forming apparatus 20.

Image forming apparatus 20 is provided with image forming device 11, sheet feeding cassette 12, image reading device 13, recording medium conveyance device 14 and control panel CP.

Image forming device 11 is composed of, photoconductor drum 5, changing device 6 to charge photoconductor drum 5 evenly, exposure device EC to radiate exposure light so as to form a electro static latent image formed on photoconductor drum 5 based on a image information, developing device 7 to develop the electro static latent image on photoconductor drum 5 as a toner image, transfer separation device 8 to transfer the toner image formed on photoconductor drum 5 to recording medium P, cleaning device 9 to scrape off remaining toner and paper dust on photoconductor drum 5 after the toner image is transferred onto the recording medium P, and fixing device 10 to melt and fix the transferred toner image on recording medium P.

Sheet cassette 12 is composed of a plurality of sheet feeding cassette (12*a* and 12*b*).

Image reading device 13 is composed of a reading optical system having light source LT, mirror group MR and imaging lens LZ, and reading device ES having electric circuit including CCD (solid-state image sensing device), and reads image information of a document placed on a platen glass (unillustrated) arranged on upper part of housing 1 or a document conveyed to a reading position by automatic document feeding device 30. Image size is obtained from the image information that read.

Recording medium feeding device 14 is composed of a plurality of rollers, guide members, and a motor to drive rollers and guide members, and it conveys recording media in straight conveyance path X1 and circulation conveyance path X2. Straight conveyance path X1 is a path from sheet cassette 12 to sheet ejection through image forming device 11 and circulation conveyance path X2 is a path where a recording sheet having image formed on one side is conveyed to image forming device again.

Control panel CP is composed of touch panel type operation display section DP, keyboard KB and start button SK, where image forming conditions and post-process are set.

ADF30 is composed of document conveyance section 31, document placing board 32 and sheet ejection section 33. Document WP placed on document placing board 32 is read by reading device ES while being conveyed to reading position by a plurality of rollers arranged in document conveyance section 31 and ejected to sheet ejection section 33. The document size can be obtained by detecting a width and a length of the document by a sensor, wherein reading document WP by reading device ES.

Post-process device 40 has on its right side surface section entrance 43 to receive the recording medium ejected from image forming device 20 and has, on its left side surface section, cover sheet feeding section n4, ejection sheet tray n9 and ejection sheet tray n10. In side the casing 41, punching section n5, intermediate stacker n6, stapler 7*n*, folding device n8 and conveyance paths R5 to R14 are provided.

In case post-process is not carried out, a recording medium conveyed to entrance 43 is ejected to sheet ejection tray n9 through conveyance paths R5 and R8.

In case stapling or folding is carried out, the recording medium conveyed to entrance 43 is stacked in intermediate stacker n6 through conveyance paths R5 and R9. In case coversheet K is used, coversheet K is supplied from cover-sheet feeding section n4 to intermediate stacker n6 through R6, R7 and R9. In intermediate stacker n6, a bundle of stacked recording media is aligned.

In case stapling is carried out, the bundle of recording media aligned by intermediate stacker n6 is stapled by stapler n7 and ejected to sheet ejecting tray n9 through conveyance path R10.

In case folding is carried out, the bundle of recording media aligned by intermediate stacker n6 is conveyed to folding device n8 through conveyance path R11 and folded by folding device n8, then ejected to sheet ejecting tray n10 through conveyance pas R12.

<Control Configuration>

Figure 2:
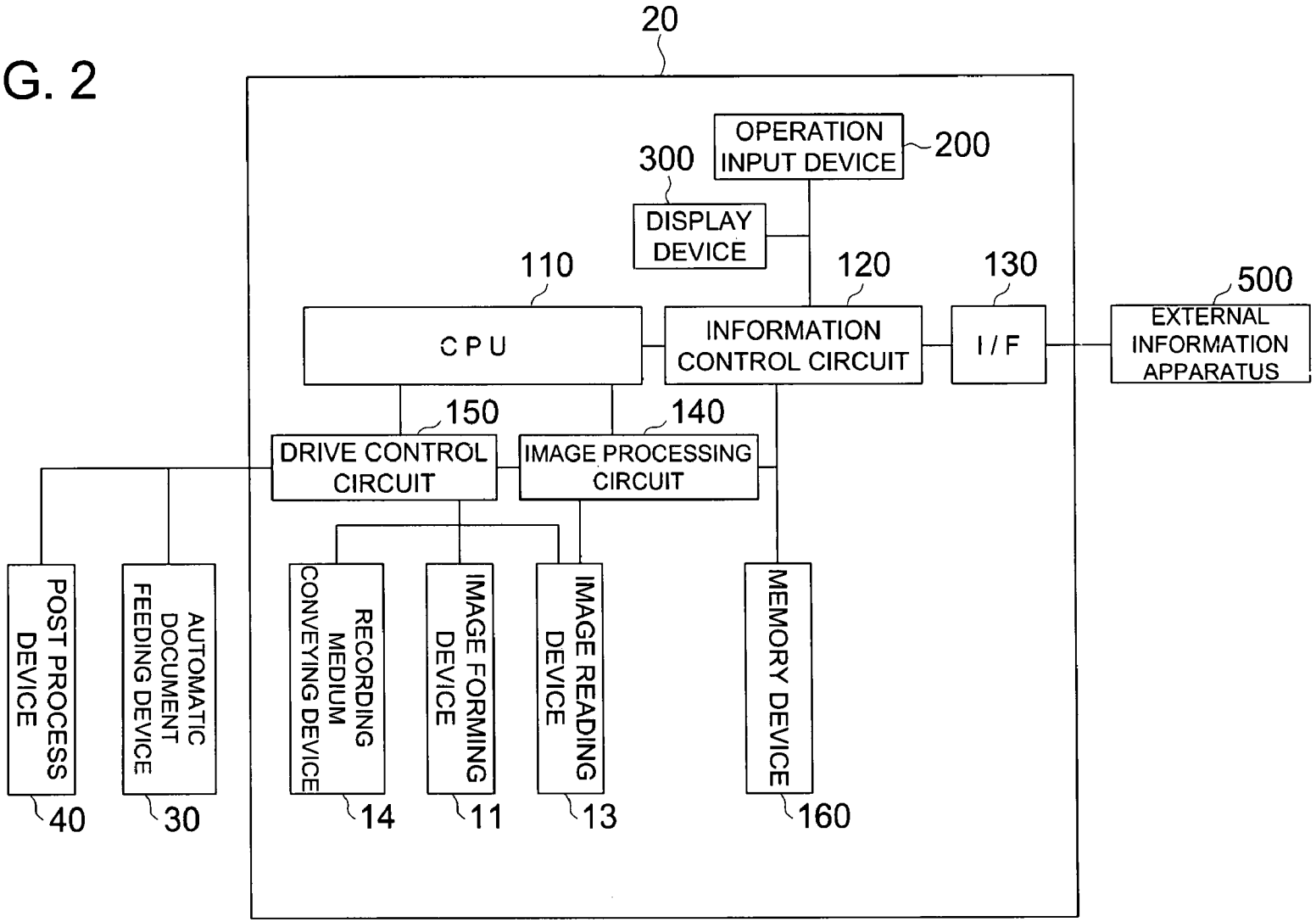
FIG. 2 is a block diagram of control of image forming apparatus of the present embodiment.

FIG. 2 is a control configuration of the image forming apparatus of the present embodiment. Image forming device 20 is composed of the following sections with a central focus on CPU 110.

A control program stored in ROM of memory device 160 to control image forming apparatus 20 and necessary data to execute the programs are downloaded to RAM of memory device 160 by CPU 110. CPU 110 controls each device of image forming device 20 and circuits based on the downloaded programs and data.

Information control circuit 120 controls input and output information based on a command of CPU 110. Information control circuit 120 is connected with external information apparatuses 500 such as personal computers, other image forming apparatus and severs through interface (I/F) 130, and obtains image information inputted from external information apparatuses 500, and setting information regarding image forming mode such as image forming conditions and post-process conditions. The image information and the setting information obtained are stored in memory device 160. Also, information control circuit 120 is connected with operation display section DP which function as operation input device 200, keyboard KB and start button SK and operation display DP which function as display deice 300 to obtain the setting information from operation input device 200 and to output display information to display device 300. The setting information is inputted from operation input device 200 or external information apparatuses 500 through I/F 130. Also, the image information is inputted from image reading device 13 or external information apparatuses 500 through I/F 130.

Image processing circuit 140 is a circuit which, for example, converts image information of the document read by image reading device 13 into digital signal based on the command of CPU 110 and compresses as image data to be stored in memory device 160, or extends and converts image data stored in memory device 160 to data or signals appropriate for an image forming method of image forming device 11.

Drive control circuit 150 is a circuit which operates image forming device 11, image reading device 13, recording medium conveying device 14, ADF 30 and post-process device 40 in predetermined operation mode based on the command CPU110 in appropriate timing to carry out image forming action.

Memory device 160 memorizes setting information composed of image information necessary for forming image and image forming conditions, parameters to operate various circuits and various devices, and various pieces of information outputted from sensors provided in various circuits and devices, and programs of various setting mode for image forming device 20 to execute.

<Outline of Control>

In the present embodiment, information-control circuit 120 judges whether or not APS mode to execute APS function is selected by operation input device 200 or external information apparatuses 500, or folding mode to apply folding is selected, then if APS mode or folding mode is selected, information control circuit 120 notifies that APS mode or folding mode is set to CPU 110.

In case APS mode is selected, CPU 110 detects document size and a placing direction from document size and the placing direction of the document placed on the platen glass, or from the setting information inputted from external information apparatuses 500. CPU 110 retrieves a recording medium matching the document in size and in placing direction among a plurality of sheet feeding cassettes 12. If the conforming recording medium is retrieved, CPU 110 instructs recording medium conveying device 14 to convey sheet toward image forming device 11. For example, a sensor is provided in sheet feeding cassette 12 so as to output the size and the placing direction of recording medium stored in sheet feeding cassette 12.

In case APS mode and folding mode are selected and set, if placing direction of a document placed on the platen glass is longitudinal (Lengthwise direction) and tri-folding is set, a longitudinal recording medium is selected in APS mode. However, in the image forming apparatus of the present invention tri-folding for longitudinal recording medium is prohibited.

In memory device 160, a table storing restriction conditions for recording media capable of being fed in case of folding mode is set, to prohibits tri-folding for longitudinal recording medium, for example.

The table is explained later using FIG. 4(C).

Thus, in the above case, CPU 110 retrieves the size and the direction of the recording medium stored in sheet cassette 12 and in case there is a recording medium at least having the same size as the document, and a direction capable of folding, in other words, in case of tri-folding, lateral recording medium (so-called different direction recording medium) exists, after forming image on the different direction recording medium by applying image processing such as image rotation for the image information of the document, the different direction recording medium is tri-folded and outputted.

<Condition Setting>

Figure 3:
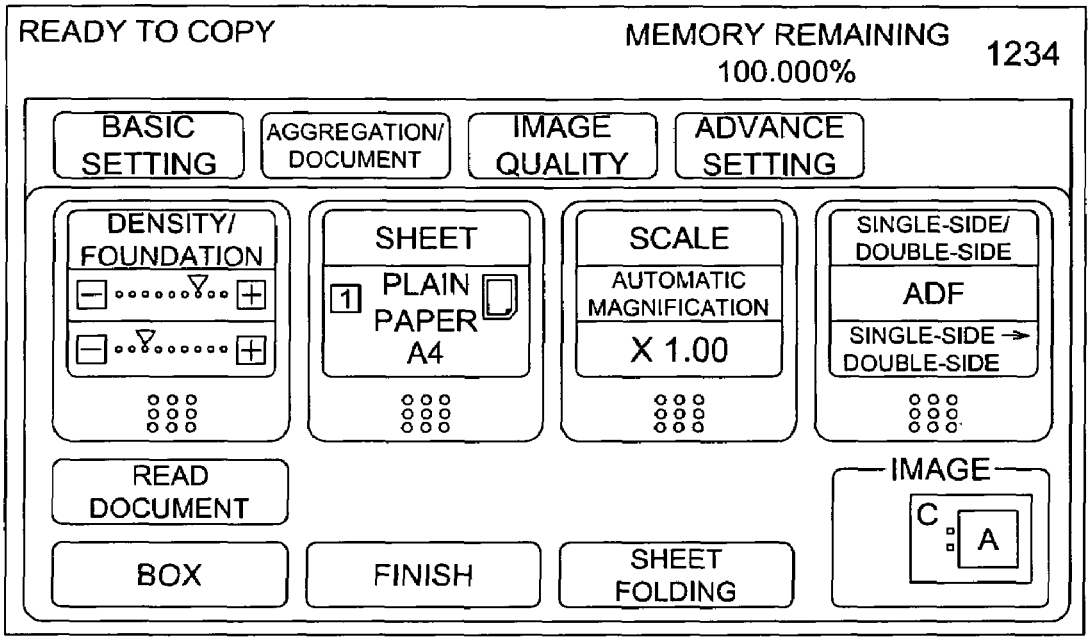
FIG. 3 is a pattern diagram showing an example of basic operation screen of the present embodiment.

Image forming conditions and post-process conditions are explained with reference to FIG. 3 and FIG. 4. Meanwhile, FIG. 3, FIG. 4(A) and FIG. 4(B) are displayed in a display device of operation display DP or external information apparatus 500. In the following explanation, a case where image forming conditions and post-process conditions are inputted through operation input device 200 is explained, however, a case of through external information apparatus 500 is also possible.

FIG. 3 shows a basic setting screen indicated in operation display section DP, and FIG. 4 shows various setting screens indicated by operating the basic setting screen. FIG. 4(A) is a setting screen for sheet folding, and FIG. 4(B) is a setting screen for the sheet. Meanwhile, FIG. 4(C) is a table stored in memory device 160, showing combination of recording medium stored in a plurality of sheet cassettes 12 in a case where folding is set, and the recording medium capable of being fed in the case thereof.

In touch panel type operation display DP, as the image forming condition, for example, a print mode such as density, sheet, magnification, and both sides/single side can be set. Further, as the post-process conditions, for example, folding setting can be set.

In case the sheet folding conditions are set, a screen indicating the sheet folding conditions shown in FIG. 4 appears when pressing a "Sheet folding" button indicated on lower part of the basic setting screen shown in FIG. 3. For example, if OK button is pressed, after pressing "tri-folding interior print", then tri-folding interior print mode is set as post-process mode.

Also, when pressing "Sheet" button in the middle of basic setting screen shown in FIG. 3 is pressed, sheet setting screen of FIG. 4(B) appears, then there is shown a sheet selection button which shows the sheet size and the sheet direction such as, for example, recording medium of A4 (A4 longitudinal), A4R (A4 lateral) stored corresponding to sheet cassette number 1 to 5. Then, if OK button is pressed, after pressing sheet selection buttons such as "A4" and "A4R", a recording medium as a sheet for A4 or A4R is selected.

Also, in case APS mode is set, if "OK" button is pressed, after "APS" button is pressed in sheet setting screen of FIG. 4(B), then APS mode is set. And in case image forming operation is carried out, a recording medium matching the placing direction and the size of the document is automatically selected and conveyed.

FIG. 4(C) is a table showing a combination of the recording medium stored in the plurality of feeding cassette 12 and the recording medium capable of being fed in case folding is set. In feeding cassette a representing the first tray, A4 size (A4 longitudinal) is stored and in feeding cassette b representing the second tray, A4R size (A4 longitudinal) is stored.

Also, "AVAILABLE" in the line corresponding to sheet feeding cassette a and b means that the recording medium is stored and "NOT AVAILABLE" means that the recording medium is not stored.

A case where tri-folding is set as the post-process for A4 (A4 longitudinal), tri-folding is not possible for A4 (A4 longitudinal) and tri-folding is possible for A4R (A4 lateral) is explained as follow as an example.

In case of the first line in FIG. 4(C), neither recording medium A4 nor A4R is stored, and none of them can not be fed.

In case of the second line, recording medium A4 is not stored but recording medium A4R is stored. Since recording medium A4R can be folded for tri-folding, recording medium A4R is fed. After turning the image information of the document 90 by degrees and then forming image on the recording medium A4R, tri-folding is carried out.

In case of the third line, recording medium A4 is stored but recording medium A4R is not stored. Since recording medium A4 is not capable of being folded for tri-folding, neither recording medium can be fed.

In case of the fourth line, both recording media A4 and A4R are stored. Since recording medium A4 is not capable of tri-folding but A4R is capable of tri-folding, recording medium A4R is fed. After turning the image information of the document by 90 degrees and then forming image on the recording medium A4R, tri-folding is carried out.

<Setting Flow of Recording Medium>

Figure 5:
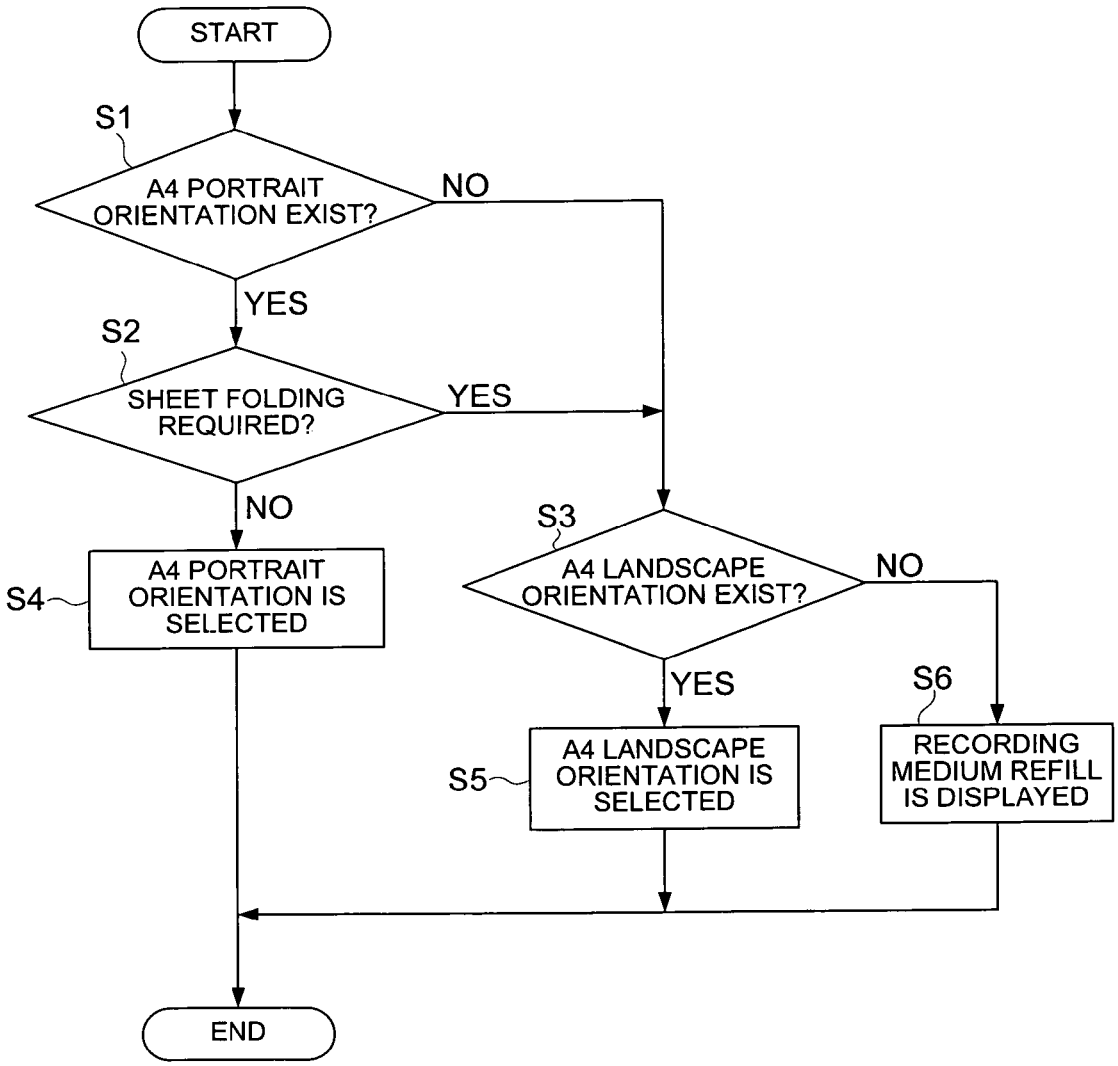
FIG. 5 is a flow chart of recording medium setting of the present embodiment.

Setting flow of recording medium of the present invention is explained with reference to FIG. 5. This flow is executed by CPU 110 based on the program stored in the ROM of memory device 160.

As an example, a case where the document is A4 (A4 longitudinal), APS and tri-folding are set, A4 (A4 longitudinal) is not capable of tri-folding, and A4R (A4 lateral) is capable of tri folding is explained supposing that APS and tri-folding have been set, document WP has been placed on document placing board 32, start button SK of control panel CP has been pressed, an image information has been inputted from image reading device 13 and the size and the placing direction of the document WP has been detected as A4(A4 longitudinal). In case the image information and setting information such as the direction of the document and the size is from the external information apparatus is off cause accepted.

Firstly, CPU 110 judges existence of sheet feeding cassette 12 to store recording medium A4 longitudinal which is the same as the document WP in the size and the placing direction (Step S1). CPU 110, for example, judges the size, the placing direction and the existence of recording medium stored in sheet cassette 12 by obtaining sensor output from available sensors.

If sheet feeding cassette 12 storing recording medium A4 longitudinal is judged to it exist (Step S1: Yes), CPU 110 judges if sheet folding is set or not (Step S2).

If sheet feeding cassette 12 storing recording medium A4 longitudinal is judged that it does not exist (Step S1: No), CPU 110 judges whether sheet feeding cassette 12 storing recording medium A4 lateral representing different direction exists or not (Step S3).

In Step S2, if sheet folding is judged that it is set (Step S2: Yes), CPU 110 advances to Step S3 then judges whether sheet feeding cassette 12 storing recording medium A4 lateral representing different direction exists or not.

In Step S2, if sheet folding is judged that it is not set (Step S2: No), CPU 110 selects sheet feeding cassette 12 storing recording medium A4 lateral (Step S4).

In Step S3, If sheet feeding cassette 12 storing recording medium A4 lateral is judged that it exists (Step S3: Yes), CPU 110 selects sheet feeding cassette 12 storing recording medium A4 lateral (Step S5).

In Step S3, if sheet feeding cassette 12 storing recording medium A4 lateral is judged that it does not exist (Step S3: No), CPU 110 indicates a message of replenishing up of recording medium on display device 300 (Step S6).

In the present embodiment, though the case of image forming apparatus having APS function has been explained, it is also applicable for a image forming apparatus having no APS function. For example, in case a user selects A4 longitudinal manually, if sheet folding is set, A4 longitudinal is changed to A4 lateral.

As mentioned above, according to the present embodiment, in case the folding is set, a recording medium capable of being folded among the same size recording media is selected, thus, interrupted of image forming due to selecting of a medium not capable of being folded is prevented, and user-friendliness is improved.

What is claimed is:

1. An image forming system, comprising:

a plurality of recording medium storing devices to store recording media;

an image input device to input image information;

an image forming device to form an image on a recording medium based on the image information inputted through the image input device;

a folding device to fold the recording medium on which the image is formed by the image forming device;

an image size obtaining device to obtain an image size of the image information inputted through the image input device;

a folding setting input device to input a folding setting; and a control device to select a recording medium storing device among the plurality of the recording medium storing devices based on the folding setting set by folding setting input device and the image size obtained by the image size obtaining device, to control the image forming device to form the image on the recording medium stored in the selected recording medium storing device based on the image information inputted through the image inputting device, and to control the folding device to fold the recording medium on which the image is formed, wherein the control device determines a size of the recording medium based on the image size obtained by the image size obtaining device.

2. The image forming system of claim 1, wherein a recording medium storing device is selected among the plurality of the recording medium storing devices based on the determined size of the recording medium and the folding setting set by the folding setting input device.

3. The image forming system of claim 2, wherein the plurality of recording medium storing devices includes recording medium storing devices which respectively store recording media having the same size and different directions, and the control device selects a recording medium storing device which stores the recording media having a direction capable of being folded by the folding device when folding is set by the folding setting input device.

4. The image forming system of claim 3, further comprising:

a memory device to memorize a table of kinds of recording media capable of being folded by the folding device;

wherein the control device selects the recording medium storing device storing the recording medium having the direction capable of being folded by the folding device based on the table.

5. The image forming system of claim 1, further comprising:

an automatic recording medium selection setting device to set an automatic recording medium selection function which automatically selects a recording medium storing device among the plurality of the recording medium storing devices based on the image size obtained by the image size obtaining device, wherein when the automatic recording medium selection setting device sets the automatic recording medium selection function, the control device selects a recording medium storing device among the plurality of the recording medium storing devices based on the folding setting set by the folding setting input device and the image size obtained by the image size obtaining device, controls the image forming device to form the image on the recording medium stored in the selected recording medium storing device based on the image information inputted through the image inputting device, and controls the folding device to fold the recording medium on which the image is formed.

6. An image forming apparatus, comprising:

a plurality of recording medium storing devices to store recording media;

an image input device to input image information;

an image forming device to form an image on a recording medium based on the image information inputted through the image input device;

an image size obtaining device to obtain an image size of the image information inputted by the image input device;

a folding setting input device to input a folding setting; and a control device to select a recording medium storing device among the plurality of the recording medium storing devices based on the image size obtained by the image size obtaining device and the folding setting set by folding setting input device, and to control the image forming device to form the image on the recording medium stored in the selected recording medium storing device based on the image information inputted through the image inputting device, wherein the control device determines a size of the recording medium is determined based on the image size obtained by the image size obtaining device.

7. The image forming apparatus of claim 6, wherein a recording medium storing device is selected among the plurality of the recording medium storing devices based on the determined size of the recording medium and the folding setting set by the folding setting input device.

8. The image forming apparatus of claim 7, wherein the plurality of recording medium storing devices includes recording medium storing devices which respectively store recording media having the same size and different directions, and the control device selects a recording medium storing device which stores the recording media having a direction capable of being folded when folding is set by the folding setting input device.

9. The image forming apparatus of claim 8, further comprising:

a memory device to memorize a table of kinds of recording media capable of being folded;

wherein the control device selects the recording medium storing device storing the recording medium having the direction capable of being folded based on the table.

10. The image forming apparatus of claim 6, further comprising:

an automatic recording medium selection setting device to set an automatic recording medium selection function which automatically selects a recording medium storing device among the plurality of the recording medium storing devices based on the image size obtained by the image size obtaining device, wherein when the automatic recording medium selection setting device sets the automatic recording medium selection function, the control device selects a recording medium storing device among the plurality of the recording medium storing devices based on the image size obtained by the image size obtaining device and the folding setting set by folding setting input device, and controls the image forming device to form the image on the recording medium stored in the selected recording medium storing device based on the image data inputted through the image inputting device.

11. A computer-readable recording medium having a computer program stored thereon that is executable by a computer to cause the computer to perform functions comprising:

inputting image information;

obtaining an image size of the image information;

inputting a folding setting;

determining a size of a recording medium based on the obtained image size;

selecting a recording medium storing device from a plurality of recording medium storing devices based on the image size and the folding setting; and forming an image on a recording medium stored in the selected recording medium storing device based on the image information.

12. The computer-readable recording medium of claim 11, wherein the recording medium storing device is selected from among the plurality of the recording medium storing devices based on the determined size of recording medium and the folding setting inputted by a folding setting input device.

13. The computer-readable recording medium of claim 12, wherein the plurality of recording medium storing devices includes recording medium storing devices which respectively store recording media having the same size and different directions; and wherein a recording medium storing device which stores the recording media having a direction capable of being folded by a folding device is selected when folding is set by the inputting of the folding setting.

14. The computer-readable recording medium of claim 13, wherein the functions further comprise:

storing a table of kinds of recording media capable of being folded;

wherein the recording medium storing device storing recording media having the direction capable of being folded is selected based on the table.

15. The computer-readable recording medium of claim 11, further performing functions comprising:

setting an automatic recording medium selection function to automatically select a recording medium storing device among the plurality of the recording medium storing devices based on the obtained image size, wherein when the automatic recording medium selection function is set, a recording medium storing device is selected from among the plurality of the recording medium storing devices based on the inputted folding setting and the obtained image size, and the image is formed on the recording medium stored in the selected recording medium storing device based on the inputted image information.

* * * * *